US008671809B1

(12) United States Patent
Chen

(10) Patent No.: US 8,671,809 B1
(45) Date of Patent: Mar. 18, 2014

(54) HAND TOOL WITH AN ADJUSTING STRUCTURE

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 0 days.

(21) Appl. No.: 13/657,867

(22) Filed: Oct. 23, 2012

(51) Int. Cl.

| | |
|---|---|
| ***B25B 23/16*** | (2006.01) |
| ***B25G 1/00*** | (2006.01) |
| ***B25B 23/00*** | (2006.01) |
| ***B25B 13/48*** | (2006.01) |

(52) U.S. Cl.
CPC ..... *B25B 23/00* (2013.01); *B25B 13/481* (2013.01); *B25B 23/16* (2013.01)
USPC ..... 81/177.8; 81/177.7

(58) Field of Classification Search
CPC ..... B25B 13/481; B25B 23/16
USPC ..... 81/177.2, 177.7, 177.8, 177.85, 177.9
See application file for complete search history.

(56) References Cited

U.S. PATENT DOCUMENTS

| | | | | |
|---|---|---|---|---|
| 6,000,302 | A * | 12/1999 | Chiang | 81/177.8 |
| 6,216,567 | B1 * | 4/2001 | Hu | 81/177.9 |
| 7,000,507 | B1 * | 2/2006 | Lin | 81/177.9 |
| 7,165,480 | B2 * | 1/2007 | Lin | 81/177.9 |
| 7,168,346 | B2 * | 1/2007 | Lin | 81/177.9 |
| 7,841,262 | B1 * | 11/2010 | Tsai | 81/177.9 |
| 2004/0177731 | A1 * | 9/2004 | Chen | 81/177.8 |

* cited by examiner

*Primary Examiner* — Monica Carter
*Assistant Examiner* — Danny Hong

(57) ABSTRACT

A hand tool with an adjusting structure includes a handle having an assembling space, an axial hole opened at a bottom of the assembling space, a controlling set having an engaging member, the engaging member received into the axial hole, the engaging member having an engaging notch opened thereon, a head member having a pivoting portion defined at one end thereof, the pivoting portion received in the assembling space, a pivoting rod passing through the assembling space and the pivoting portion at one end of the handle, the pivoting portion having a plurality of ratch teeth defined thereon, the engaging member engages with one ratch tooth of the pivoting portion. Under this arrangement, when the user wants to adjust an angle between the handle and the head member, the user rotates the head member relative the handle.

3 Claims, 5 Drawing Sheets

HAND TOOL WITH AN ADJUSTING STRUCTURE

BACKGROUND OF THE INVENTION

1. Field of the Invention

The present invention relates to a hand tool and more particularly to a hand tool with an adjusting structure, in which an angle between a handle and a head member pivoted on the handle is adjustable.

2. Description of Related Art

A conventional hand tool with an adjusting structure comprises a head including an end with an arcuate toothed face, a handle including an end defining a compartment for pivotal connection with the end of the head, the handle including a longitudinal hole having an inner end and an outer end communicated with the compartment, the handle further including a transverse hole communicated with the inner end of the longitudinal hole and a reduced hole intercommunicated between the transverse hole and the inner end of the longitudinal hole, a catch mounted in the longitudinal hole and including a first end with an arcuate toothed surface and a second end including a stub extended through the reduced hole, the arcuate toothed surface having more than ten teeth so that the teeth of the head can be engaged with the arcuate toothed surface of the catch by more than ten teeth to thereby provide a reliable retaining effect, a push button mounted in the transverse hole and including a stem, the stem including a relatively higher portion and a relatively lower portion, means for biasing the push button to a retaining position in which the second end of the catch engages with the relatively higher portion of the stem such that the arcuate toothed surface of the catch is biased to engage with the arcuate toothed face of the head, thereby retaining the head in an angular position relative to the handle, and wherein when the push button is pushed, the second end of the catch is disengaged from the relatively higher portion of the stem such that the arcuate toothed surface of the catch is disengaged from the arcuate toothed face of the head, thereby allowing adjustment of the angular position of the head relative to the handle; and an elastic member being mounted around the stub for assisting in bias of the catch toward the head when the push button is in its retaining position.

However, the conventional hand tool with an adjusting structure has one disadvantage as following:

Although the arcuate toothed surface of the catch has more than ten teeth so as to provide the reliable retaining effect on the head, the catch is high-cost because the catch has more than ten teeth. In addition, each tooth of the head must completely match each tooth of the catch so that a high precision for manufacturing is necessary. Therefore, the conventional hand tool with an adjusting structure would be expensive.

The present invention has arisen to mitigate and/or obviate the disadvantages of the conventional.

SUMMARY OF THE INVENTION

The main objective of the present invention is to provide an improved hand tool.

To achieve the objective, a hand tool with an adjusting structure comprises a handle having an assembling space defined at one end thereof, an axial hole opened at a bottom of the assembling space, a transverse hole opened at one literal side of the handle, the transverse hole communicating with the axial hole, a controlling set having a push button, an engaging member and a transverse elastomer, the engaging member received into the axial hole, the engaging member being axially movable in the axial hole, the engaging member having an engaging head and a stub, the engaging head having an engaging notch opened thereon, the engaging head having a left abutting surface and a right abutting surface which are respectively defined at two outer sides of the engaging notch, the push button received into the transverse hole, the push button being axially movable in the transverse hole, an opened space defined on an upper side of the push button, so that the opened space corresponds to the axial hole, a step block defined in the opened space, the engaging member abutting against the step block, the transverse elastomer enclosing the push button, two ends of the transverse elastomer respectively abutting against a bottom of the transverse hole and the push button, a head member having a pivoting portion defined at one end thereof, the pivoting portion of the head member received in the assembling space, a pivoting rod passing through the assembling space and the pivoting portion at one end of the handle, one end of the pivoting portion formed as arc-shaped and having a plurality of ratch teeth defined thereon, each ratch tooth having a right surface and a left surface respectively defined at two sides thereof, the right surface and the left surface of each ratch tooth respectively corresponding to the left abutting surface and the right abutting surface of the engaging member. Wherein, an area of the left abutting surface and another area of the right abutting surface are respectively larger than the right surface and the left surface; the transverse hole has an enlarged space at an outer end thereof and a reduced space at an inner end thereof; the enlarged space communicates with the reduced space; an area of the enlarged space is larger than the reduced space; the push button has a push end and a stem at two ends thereof; the stem is connected to the push end; the opened space and the step block are both located at the stem; the stem of the push button is received into the reduced space; the push end of the push button is movable in the enlarged space; the transverse elastomer encloses the stem of the push button; two ends of the transverse elastomer respectively abut against a bottom of the enlarged space and the push end; an axial elastomer encloses the stub of the engaging member; two ends of the axial elastomer respectively abut against a bottom of the axial hole and the engaging head of the engaging member. Under this arrangement, when the engaging head of the engaging member engages with one ratch tooth of the pivoting portion, the above one ratch tooth is received into the engaging notch of the engaging head; in addition, there are two adjacent ratch teeth at two sides of the above one ratch tooth; the right surface of one adjacent ratch tooth abuts against the left abutting surface of the engaging head; the left surface of another adjacent ratch tooth abuts against the right abutting surface of the engaging head.

Further benefits and advantages of the present invention will become apparent after a careful reading of the detailed description with appropriate reference to the accompanying drawings.

DETAILED DESCRIPTION OF THE INVENTION

Figure 1:
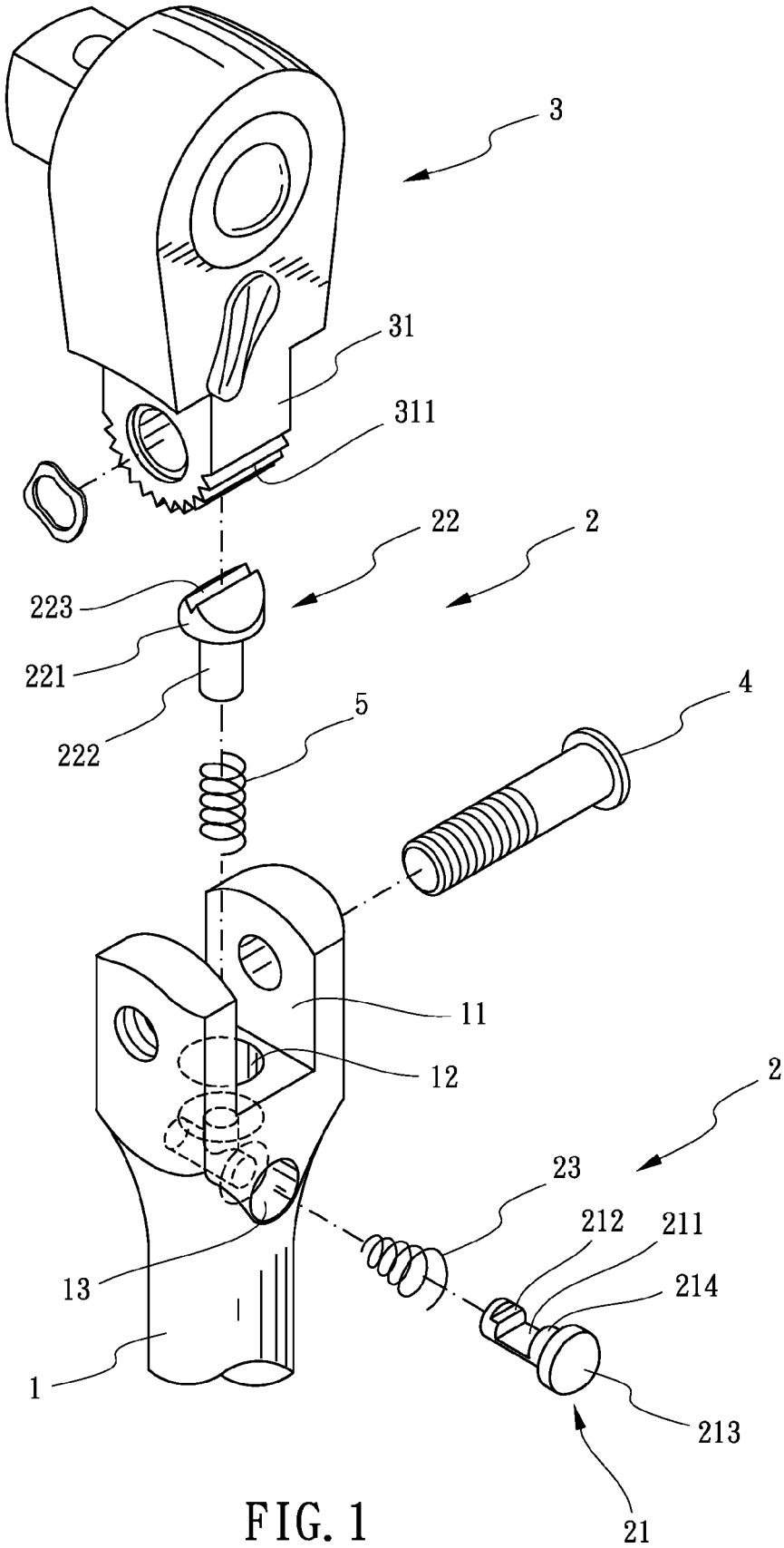
FIG. 1 is an exploded view of a hand tool with an adjusting structure of the present invention.
Figure 2:
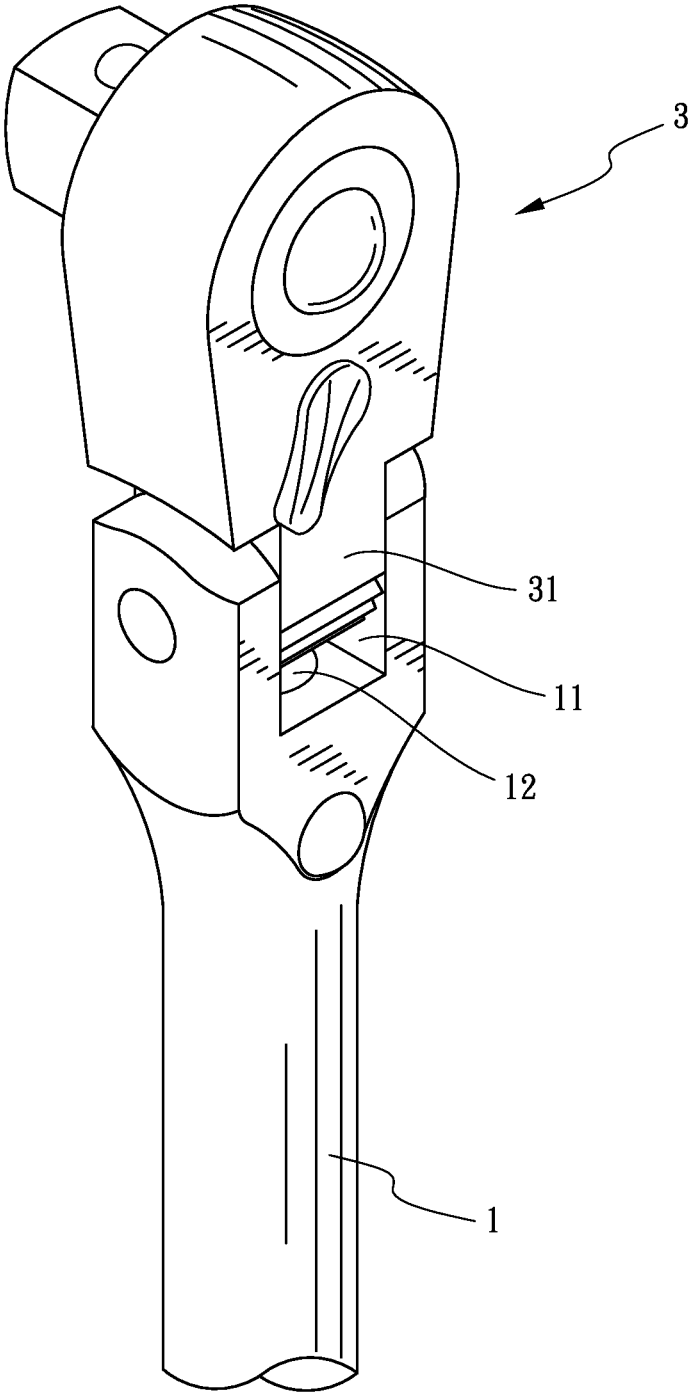
FIG. 2 is a perspective view of the hand tool with an adjusting structure.
Figure 3:
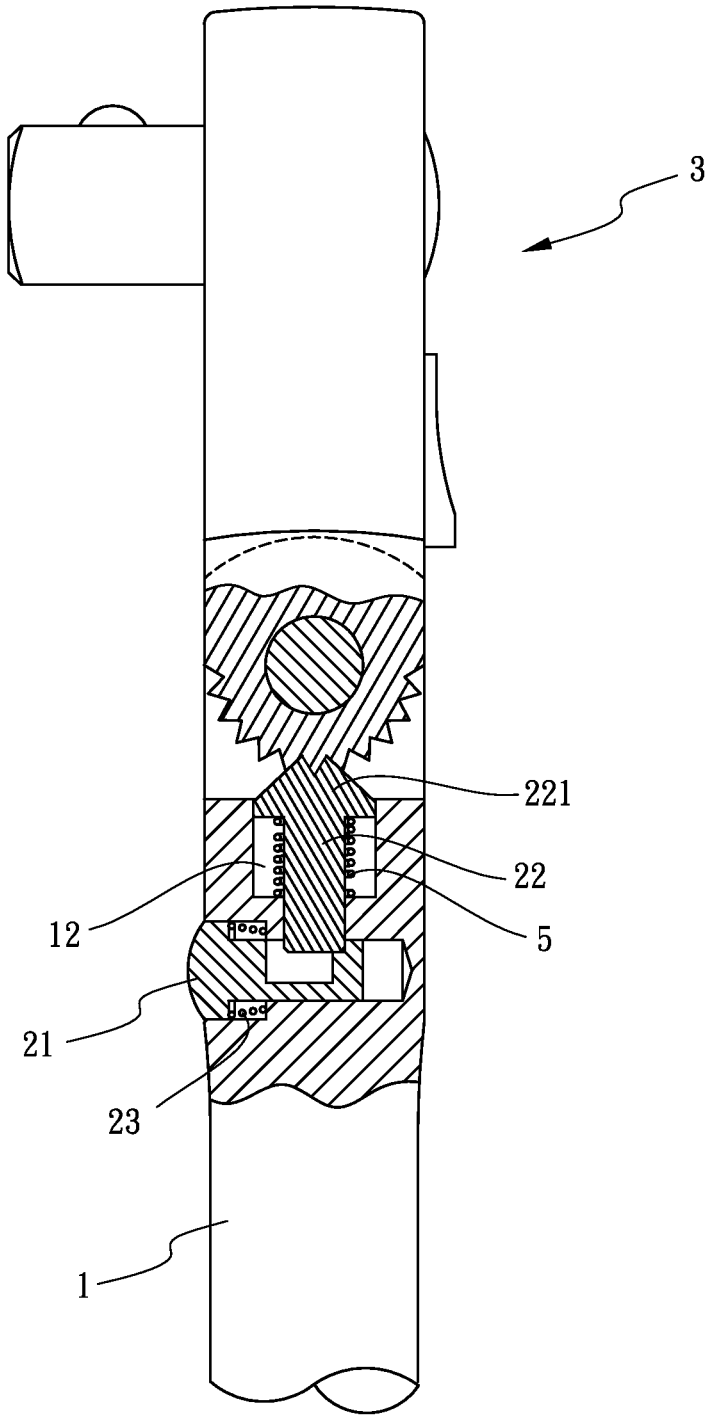
FIGS. 3-4 are side views for showing an adjusting operation of the present invention.
Figure 4:
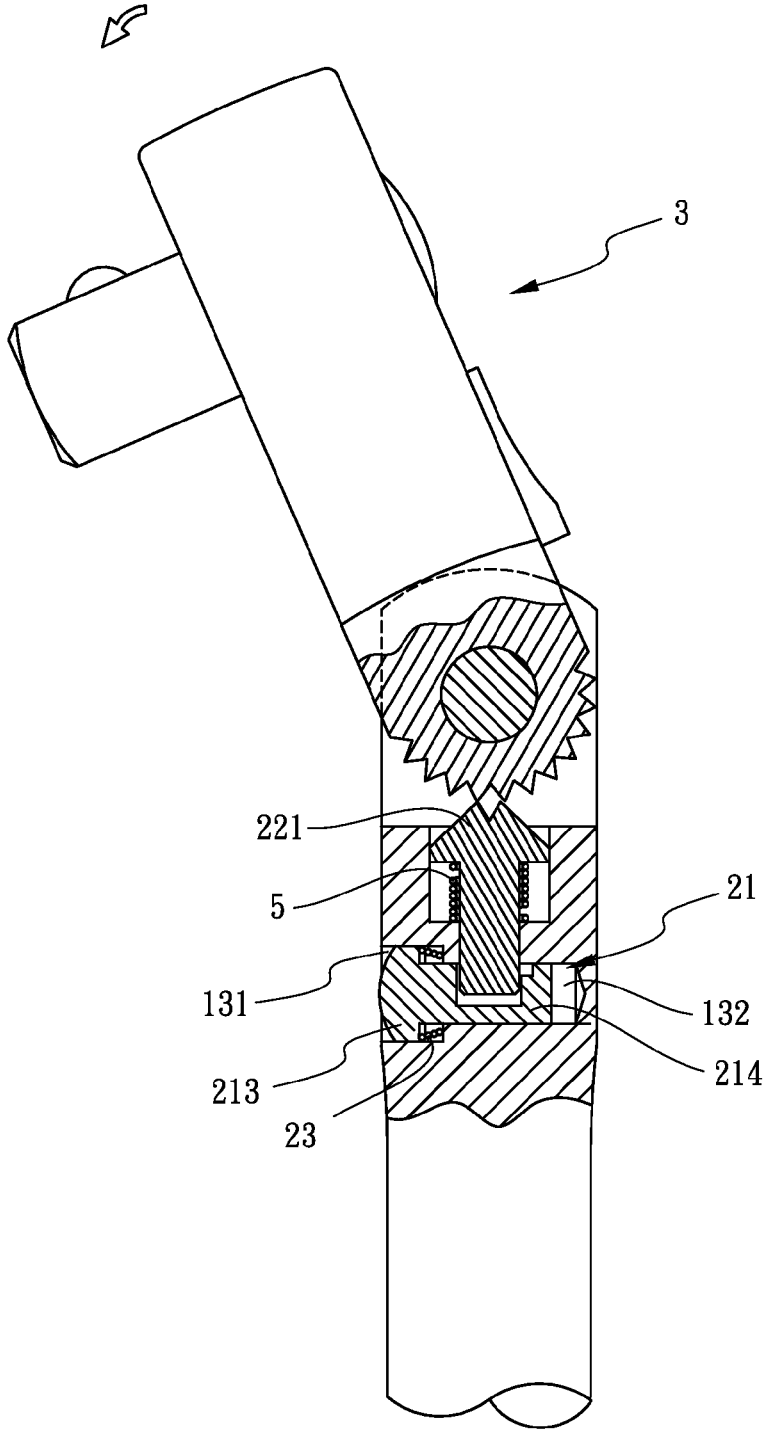

Referring to FIGS. 1-5, a hand tool with an adjusting structure in accordance with the present invention comprises a handle 1, a controlling set 2, a head member 3 and a pivoting rod 4. The handle 1 has an assembling space 11 defined at one end thereof. An axial hole 12 is opened at a bottom of the assembling space 11. A transverse hole 13 is opened at one literal side of the handle 1. The transverse hole 13 communicates with the axial hole 12.

Figure 5:
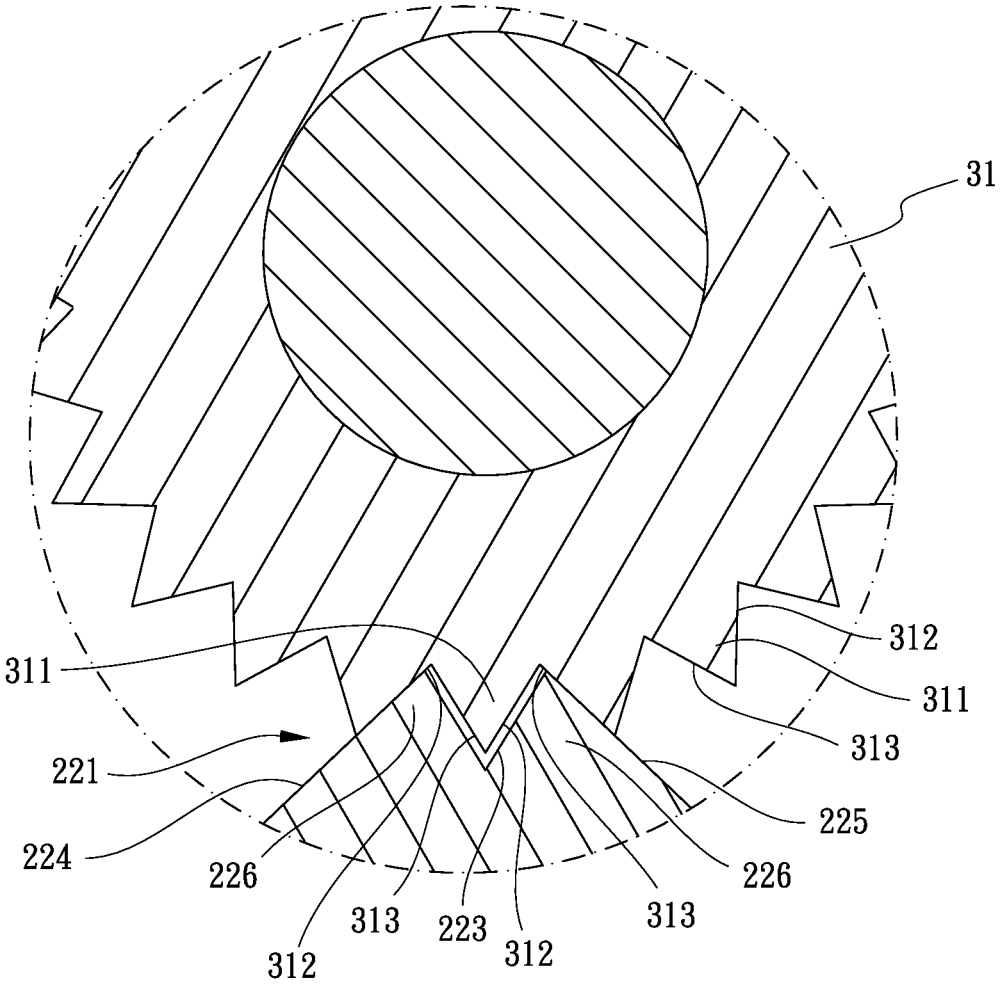
FIG. 5 is an enlarged view for showing an engagement between an engaging member and a head member.

The controlling set 2 has a push button 21, an engaging member 22 and a transverse elastic member 23. The engaging member 22 is received into the axial hole 12. The engaging member 22 is axially movable in the axial hole 12. The engaging member 22 has an engaging head 221 and a stub 222. The engaging head 221 defines two engaging teeth 226 at a top thereof and an engaging notch 223 between the two engaging teeth 226 of the engaging head 221, as shown in FIG. 5. The engaging head 221 has a left abutting surface 224 and a right abutting surface 225 which are respectively defined at two outer sides of the two engaging teeth 226. The push button 21 is received into the transverse hole 13. The push button 21 is axially movable in the transverse hole 13. A recess 211 is defined in an upper side of the push button 21, so that the recess 211 corresponds to the axial hole 12. A step block 212 is defined in the recess 211. The engaging member 22 abuts against the step block 212. The transverse elastic member 23 encloses the push button 21. Two ends of the transverse elastic member 23 respectively abut against a wall of the transverse hole 13 and the push button 21.

The head member 3 has a pivoting portion 31 defined at one end thereof. The pivoting portion 31 of the head member 3 is received in the assembling space 11. The pivoting rod 4 passes through the assembling space 11 and the pivoting portion 31 at one end of the handle 1, so that the head member 3 is pivoted on the handle 1 via the pivoting portion 31 thereof and the pivoting rod 4. One end of the pivoting portion 31 is formed as arc-shaped and has a plurality of teeth 311 defined thereon. Each tooth 311 has a right tooth surface 312 and a left tooth surface 313 respectively defined at two sides thereof. The right tooth surface 312 and the left tooth surface 313 of each tooth 311 respectively correspond to the left abutting surface 224 and the right abutting surface 225 of the engaging member 22, as shown in FIG. 5. The engaging head 221 of the engaging member 22 engages with a selected one of the teeth 311 of the pivoting portion 31. Referring to FIG. 5 a width of the engaging notch 223 is slightly larger than a width of each tooth 311, so that a gap is defined between each tooth 311 and the engaging notch 223 so as to prevent the engaging notch 223 and each tooth 311 from being abraded. Under this arrangement, the selected tooth 311 of the pivoting portion 31 is received in the engaging notch 223 of the engaging head 221; specifically, the right tooth surface 312 and the left tooth surface 313 are respectively spaced a distance apart from a wall of the engaging notch 223.

The above disclosure is enough to perform preferred functions in the embodiment of the present invention.

The detail of the operation for adjusting an angle between the head member 3 and the handle 1 and positioning the head member 3 is described as following.

First, the user presses the push button 21 and rotates the head member 3 relative to the handle 1; simultaneously, the engaging head 221 is disengaged from the selected tooth 311, and the tooth 311 presses the engaging head 221 so as to push the engaging member 22 toward the recess 211; in addition, the transverse elastomer 23 is compressed by the push button 21.

Second, when the angle between the head member 3 and the handle 1 is suitable, the user stops rotating the head member 3 and releases the push button 21, so that a recovery force of the transverse elastomer 23 pushes the push button 21 back; as a result, the engaging head 221 engages with another tooth 311 of the pivoting portion 31 via the above motion of the push button 21, so that the respective tooth 311 is received into the engaging notch 223 of the engaging head 221. In addition, there are two adjacent teeth 311 at two sides of the above tooth 311; the right tooth surface 312 of one adjacent tooth 311 abuts against the left abutting surface 224 of the engaging head 221; the left tooth surface 313 of another adjacent tooth 311 abuts against the right abutting surface 225 of the engaging head 221 so as to uphold the head member 3 (as shown in FIG. 5).

Therefore, the head member 3 is positioned firmly via the right tooth surface 312 and the left tooth surface 313 of each tooth 311 thereof, and the left abutting surface 224 and the right abutting surface 225 of the engaging member 22; the left abutting surface 224 and the right abutting surface 225 tightly abut against the right tooth surface 312 and the left tooth surface 313 respectively, so as to prevent the friction between each tooth 311 and the engaging head 221 during the operation.

Furthermore, referring to FIGS. 1-5, an area of the left abutting surface 224 and that of the right abutting surface 225 are respectively larger than the right tooth surface 312 and the left tooth surface 313, so that the engaging notch 223 does not completely match each tooth 311 and a high precision for manufacturing is not necessary. The transverse hole 13 has an enlarged space 131 at an outer end thereof and a reduced space 132 at an inner end thereof. The enlarged space 131 communicates with the reduced space 132. An area of the enlarged space 131 is larger than the reduced space 132. The push button 21 has a head 213 and a stem 214 at two ends thereof. The stem 214 is connected to the head 213. The head 213 of the push button 21 is partially exposed from the enlarged space 131 of the transverse hole 13. The recess 211 and the step block 212 are both located at the stem 214. The stem 214 of the push button 21 is received into the reduced space 132. The head 213 of the push button 21 is movable in the enlarged space 131. The transverse elastomer 23 encloses the stem 214 of the push button 21. Two ends of the transverse elastomer 23 respectively abut against a wall of the enlarged space 131 and the head 213. When the user presses the push button 21, the motion of the push button 21 is limited in the enlarged space 131 and the transverse elastomer 23 is compressed by the push button 21. In contrast, when the user releases the push button 21, the recovery force of the transverse elastomer 23 pushes the push button 21 back; as a result, the stub 222 of the engaging member 22 is moved from recess 211 to the step block 212, so that the engaging notch 223 engages with the pivoting portion 31; in addition, the push button 21 supports the engaging member 22 at the step block 212 thereof via the recovery force of the transverse elastomer 23. Specifically, an axial elastomer 5 encloses the stub 222 of the engaging member 22. Two ends of the axial elastomer 5 respectively abut against a bottom of the axial hole 12 and the engaging head 221 of the engaging member 22. Therefore, when the user presses the push button 21 and rotates the head member 3 relative to the handle 1, the engaging head 221 is disengaged from the teeth 311 step by step by the compression of the axial elastomer 5.

Although the invention has been explained in relation to its preferred embodiment, it is to be understood that many other possible modifications and variations can be made without departing from the spirit and scope of the invention as hereinafter claimed.

The invention claimed is:

1. A hand tool, comprising:

a handle having an assembling space defined at one end thereof, an axial hole defined in a bottom of the assembling space, a transverse hole defined at one lateral side of the handle and communicating with the axial hole;

a head member having a pivoting portion defined at one end thereof and received in the assembling space of the handle, the pivoting portion being arc-shaped with one end and having a plurality of teeth defined at an outer periphery of the pivoting portion, each tooth of the pivoting portion defining two tooth surfaces;

a pivoting rod connecting the head member and the handle so that the head member is pivoted to the handle;

an engaging member mounted in the axial hole of the handle and engaged with a selected one of the teeth of the head member, the engaging member having an engaging head at one end and a stub at the other end, the engaging head defining two engaging teeth at one end and a notch defined between the two engaging teeth, the selected tooth of the pivoting portion received in the notch of the engaging head and each tooth surface of the selected tooth and a wall of the notch being spaced apart in a distance, the engaging head having two abutting surfaces abutting against two adjacent teeth to retain uphold the head member;

a push button mounted in the transverse hole, the push button having a head and a stem respectively defined at two end thereof, a recess defined in the stem and a step block defined in the recess, the stub of the engaging member selectively abutted against the step block or inserted into the recess to control the engaging member; and an axial elastic member mounted around the stub of the engaging member and abutting against the engaging head of the engaging member and a wall of the axial hole; and a transverse elastic member mounted around the stem of the push button and abutting against the head of the push button and a wall of the transverse hole.

2. The hand tool as claimed in claim, wherein an area of the abutting surface of the respective engaging tooth is that of each tooth surface of the respective tooth.

3. The hand tool as claimed in claim 1, wherein the transverse hole has an enlarged space at an outer end thereof and a reduced space at an inner end thereof; the enlarged space communicates with the reduced space;

the stem of the push button is received into the reduced space; the head of the push button is movable in the enlarged space; the transverse elastomer encloses the stem of the push button; two ends of the transverse elastomer respectively abut against a bottom of the enlarged space and the push end.

* * * * *